US006587077B2

(12) United States Patent
Vail et al.

(10) Patent No.: US 6,587,077 B2
(45) Date of Patent: Jul. 1, 2003

(54) PHASED ARRAY ANTENNA PROVIDING ENHANCED ELEMENT CONTROLLER DATA COMMUNICATION AND RELATED METHODS

(75) Inventors: David Kenyon Vail, West Melbourne, FL (US); Frank J. Tabor, Melbourne, FL (US); Daniel P. Blom, Palm Bay, FL (US); Stephen S. Wilson, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/991,482

(22) Filed: Nov. 9, 2001

(65) Prior Publication Data

US 2002/0070898 A1 Jun. 13, 2002

Related U.S. Application Data

(60) Provisional application No. 60/255,007, filed on Dec. 12, 2000.

(51) Int. Cl.[7] ..... H01Q 3/02; H01Q 3/12

(52) U.S. Cl. ..... 342/374; 342/372; 342/368

(58) Field of Search ..... 342/374, 372, 342/368

(56) References Cited

U.S. PATENT DOCUMENTS

| | | | | |
|---|---|---|---|---|
| 4,277,787 | A | * 7/1981 | King | |
| 4,931,803 | A | 6/1990 | Shimko | 342/371 |
| 4,980,691 | A | 12/1990 | Rigg et al. | 342/372 |
| 4,994,814 | A | 2/1991 | Aoki et al. | 342/372 |
| 4,996,532 | A | 2/1991 | Kirimoto et al. | 342/81 |
| 5,008,680 | A | 4/1991 | Willey et al. | 342/372 |
| 5,027,126 | A | 6/1991 | Basehgi et al. | 342/372 |
| 5,072,228 | A | 12/1991 | Kuwahara | 342/360 |
| 5,225,841 | A | 7/1993 | Krikorian et al. | 342/204 |
| 5,231,405 | A | 7/1993 | Riza | 342/375 |
| 5,243,274 | A | 9/1993 | Kelsey et al. | 324/158 R |
| 5,283,587 | A | 2/1994 | Hirshfield et al. | 342/372 |
| 5,353,031 | A | 10/1994 | Rathi | 342/372 |
| 5,493,255 | A | 2/1996 | Murtojarvi | 330/296 |
| 5,559,519 | A | 9/1996 | Fenner | 342/174 |
| 5,592,179 | A | 1/1997 | Windyka | 342/372 |
| 5,655,841 | A | 8/1997 | Storm | 374/183 |
| 5,680,141 | A | 10/1997 | Didomenico et al. | 342/372 |
| 5,771,016 | A | 6/1998 | Mullins et al. | 342/372 |
| 5,938,779 | A | 8/1999 | Preston | 714/718 |
| 5,990,830 | A | 11/1999 | Vail et al. | 342/368 |
| 5,995,740 | A | 11/1999 | Johnson | 395/500.41 |
| 5,999,990 | A | 12/1999 | Sharrit et al. | 718/8 |
| 6,011,512 | A | 1/2000 | Cohen | 342/372 |
| 6,023,742 | A | 2/2000 | Ebeling et al. | 710/107 |
| 6,140,976 | A | * 10/2000 | Locke et al. | 342/374 |
| 6,157,681 | A | 12/2000 | Daniel et al. | 375/298 |
| 6,163,220 | A | 12/2000 | Schellenberg | 330/295 |
| 6,172,642 | B1 | 1/2001 | DiDomenico et al. | 342/368 |

* cited by examiner

*Primary Examiner*—Theodore M. Blum
(74) *Attorney, Agent, or Firm*—Allen, Dyer, Doppelt, Milbrath & Gilchrist, P.A.

(57) ABSTRACT

A phased array antenna may include a substrate and a plurality of phased array antenna elements carried by the substrate, and a plurality of element controllers connected to the phased array antenna elements. Each element controller may be switchable between inactive and active data receiving states. The phased array antenna may further include a plurality of subarray controllers and a plurality of data buses. Each data bus may connect a respective subarray controller to respective columns and rows of element controllers. Further, each subarray controller may cooperate with a respective data bus for sending data in parallel to a plurality of rows of element controllers and while sequentially switching a given column of element controllers from the inactive data receiving state to the active data receiving state

38 Claims, 5 Drawing Sheets

PHASED ARRAY ANTENNA PROVIDING ENHANCED ELEMENT CONTROLLER DATA COMMUNICATION AND RELATED METHODS

RELATED APPLICATION

This application is based upon prior filed copending provisional application Ser. No. 60/255,007 filed Dec. 12, 2000, now abandoned the entire subject matter of which is incorporated herein by reference in its entirety.

FIELD OF THE INVENTION

The present invention relates to the field of communications, and, more particularly, to phased array antennas and related methods.

BACKGROUND OF THE INVENTION

Antenna systems are widely used in both ground based applications (e.g., cellular antennas) and airborne applications (e.g., airplane or satellite antennas). For example, so-called "smart" antenna systems, such as adaptive or phased array antennas, combine the outputs of multiple antenna elements with signal processing capabilities to transmit and/or receive communications signals (e.g., microwave signals, RF signals, etc.). As a result, such antenna systems can vary the transmission or reception pattern (i.e., "beam shaping" or "spoiling") or direction (i.e., "beam steering") of the communications signals in response to the signal environment to improve performance characteristics.

A typical phased array antenna may include, for example, a central controller for processing the host commands and generating beam control commands (e.g., beam steering commands and/or beam spoiling commands) for the antenna elements based thereon. One or more element controllers may be used for controlling the antenna elements based upon the beam control commands. In larger phased array antennas, subarray controllers may also be connected between groups of element controllers and the central controller to aid in beam command processing and distribution, for example.

One problem that may become particularly acute in large phased array antennas is that of efficiently distributing the beam commands from the subarray controllers to the element controllers. This is partly due to the fact that some beam commands are particular to a given element controller (e.g., initialization commands, phase commands, attenuation commands, delay commands), while others may be intended for all of the element controllers (e.g., beam spoiling commands, operating frequency commands). Thus, some degree of individual element addressing is typically required. Yet, many of these commands generally require distribution to the element controllers in as close to real time as is possible. This problem may be further complicated by the fact that other data may also need to be communicated to and from the element controllers, such as temperature compensation data or telemetry data, for example.

Several prior art approaches exist for sending and receiving data to and from element controllers. For example, one such approach is to arrange the group of element controllers associated with each subarray controller into rows and columns, and individually address each of the element controllers to send data thereto. A disadvantage of this approach is that numerous sequential addressing commands must be used, for example, to sequentially address each of the element controllers in a group. Further, common data such as headers, etc., to be sent to all of the element controllers must be repeatedly sent to each of the element controllers, adding further delays.

One variation of this approach is to address an entire column of element controllers in a group and then sequentially address each element in the column. While this variation may provide some improvement, numerous sequential addressing commands and repeated sending of data may still be required.

Another prior art approach is to provide a dedicated data link from each subarray controller to each of its associated element controllers. By way of example, U.S. Pat. No. 5,353,031 to Rathi discloses an integrated module controller which, in one embodiment, is to have a respective data link for each of its associated antenna elements. In this embodiment, the module controller transmits data to all of its associated antenna elements in parallel. Yet, this approach simply may not be practical in large phased array antennas having numerous antenna elements, due to the wiring complexities that are likely to result.

A still further approach uses a respective multiplexed bus connected between each subarray controller and subgroups of associated element controllers. In such an approach, the element controllers will have addressing straps, for example, so that individual element controllers within each subgroup can be controlled to receive respective data. An example of this type of architecture is also disclosed in the above noted patent to Rathi, where in one embodiment a subgroup of row elements or column elements share a common multiplexed data bus with each element receiving respective control addressing signals. While this approach also has certain advantages, it may require high bus data rates, and it may also be cumbersome to implement address straps for large numbers of elements controllers.

SUMMARY OF THE INVENTION

In view of the foregoing background, it is therefore an object of the present invention to provide a phased array antenna with enhanced element controller data communication and related methods.

This and other objects, features, and advantages in accordance with the present invention are provided by a phased array antenna including a substrate and a plurality of phased array antenna elements carried by the substrate, and a plurality of element controllers connected to the phased array antenna elements. Each element controller may be switchable between inactive and active data receiving states. The phased array antenna may further include a plurality of subarray controllers and a plurality of data buses. Each data bus may connect a respective subarray controller to respective columns and rows of element controllers. Further, each subarray controller may cooperate with a respective data bus for sending data in parallel to a plurality of rows of element controllers and while sequentially switching a given column of element controllers from the inactive data receiving state to the active data receiving state. Accordingly, the phased array antenna according to the present invention provides enhanced element controller data communication while reducing the need for relatively high speed busses and complex addressing protocols, which may otherwise result in increased logic complexity, power consumption, and cost.

More particularly, each subarray controller may send data in parallel to all of the rows of element controllers and while sequentially switching a given column of element controllers from the inactive data receiving state to the active data receiving state. Each subarray controller may further switch a plurality of columns of element controllers (e.g., all of the columns of element controllers) to the active data receiving state to send common data thereto. By way of example, the common data may include at least one of beam shape data, temperature compensation data (e.g., temperature compensation index data), and operating frequency data.

Each subarray controller may provide clock signals to switch the columns of element controllers between inactive and active data receiving states. For example, the clock signals may be offset in time from one another to sequentially switch the columns. Also, respective clock signals may be substantially the same to activate a plurality of columns. A significant advantage of this method is that the common data and the individual data for each column can be efficiently intermixed on the same bus, using a common message header. Because a column of element controllers in the inactive data receiving state has no clock, it does not "see" the data being multiplexed, and this allows for a relatively simple design of the element controller receiver logic.

The data may include beam steering data, for example, and the plurality of element controllers may be a respective element controller connected to each of the phased array antenna elements. Furthermore, the phased array antenna may also include a central controller connected to the plurality of subarray controllers. Additionally, each subarray controller may send a telemetry request command to at least one column of element controllers, and each element controller in the at least one column may respond to the telemetry request command by sending requested telemetry data. A method aspect of the invention is for sending data between a subarray controller and a plurality of element controllers in a phased array antenna. Each element controller may be switchable between inactive and active data receiving states. The method may include sending the data in parallel from the subarray controller to a plurality of rows of the element controllers, and sequentially switching a given column of the element controllers from the inactive data receiving state to the active data receiving state while sending the data in parallel.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
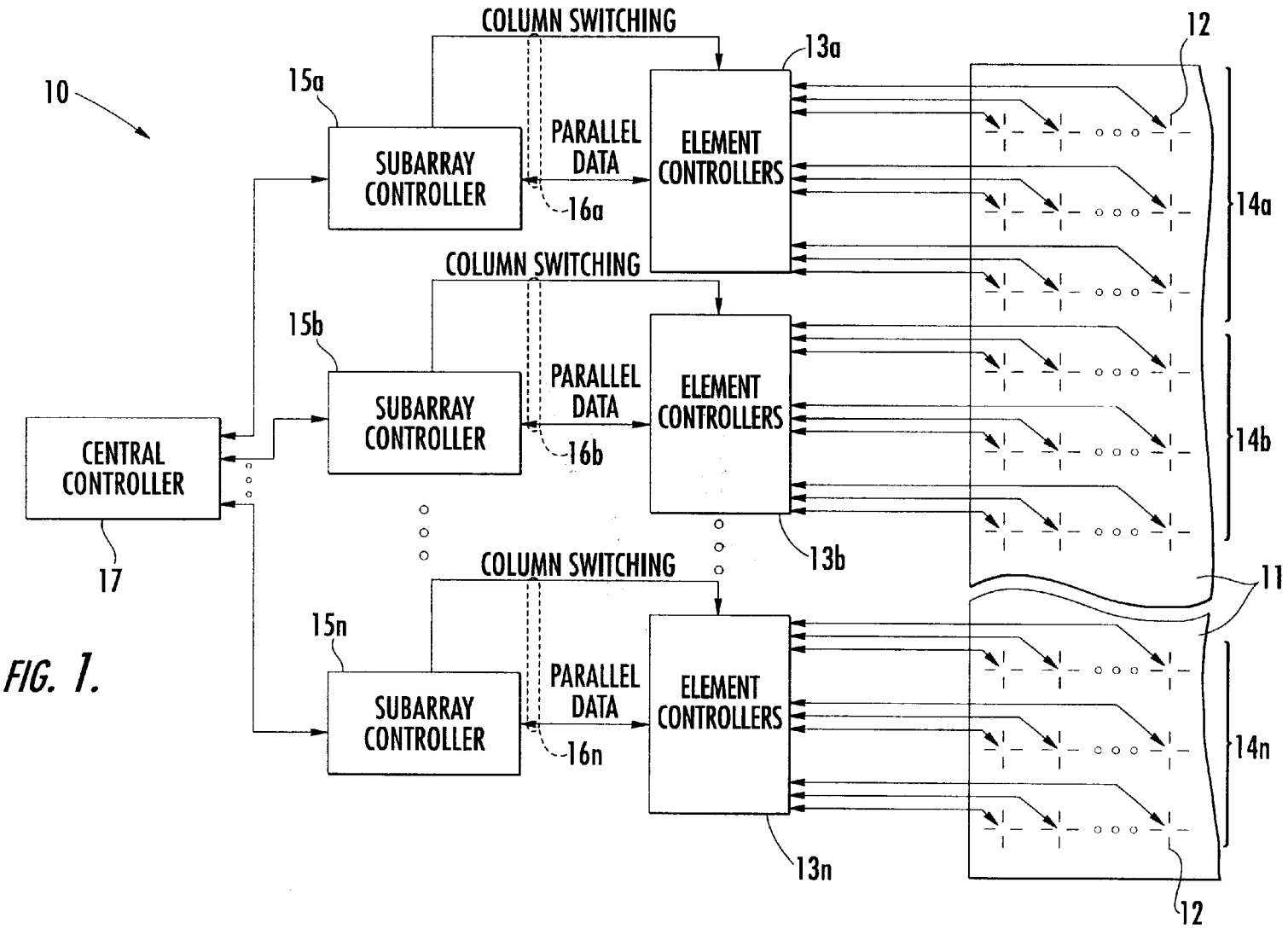
FIG. 1 is a schematic block diagram of a phased array antenna of the present invention.
Figure 2:
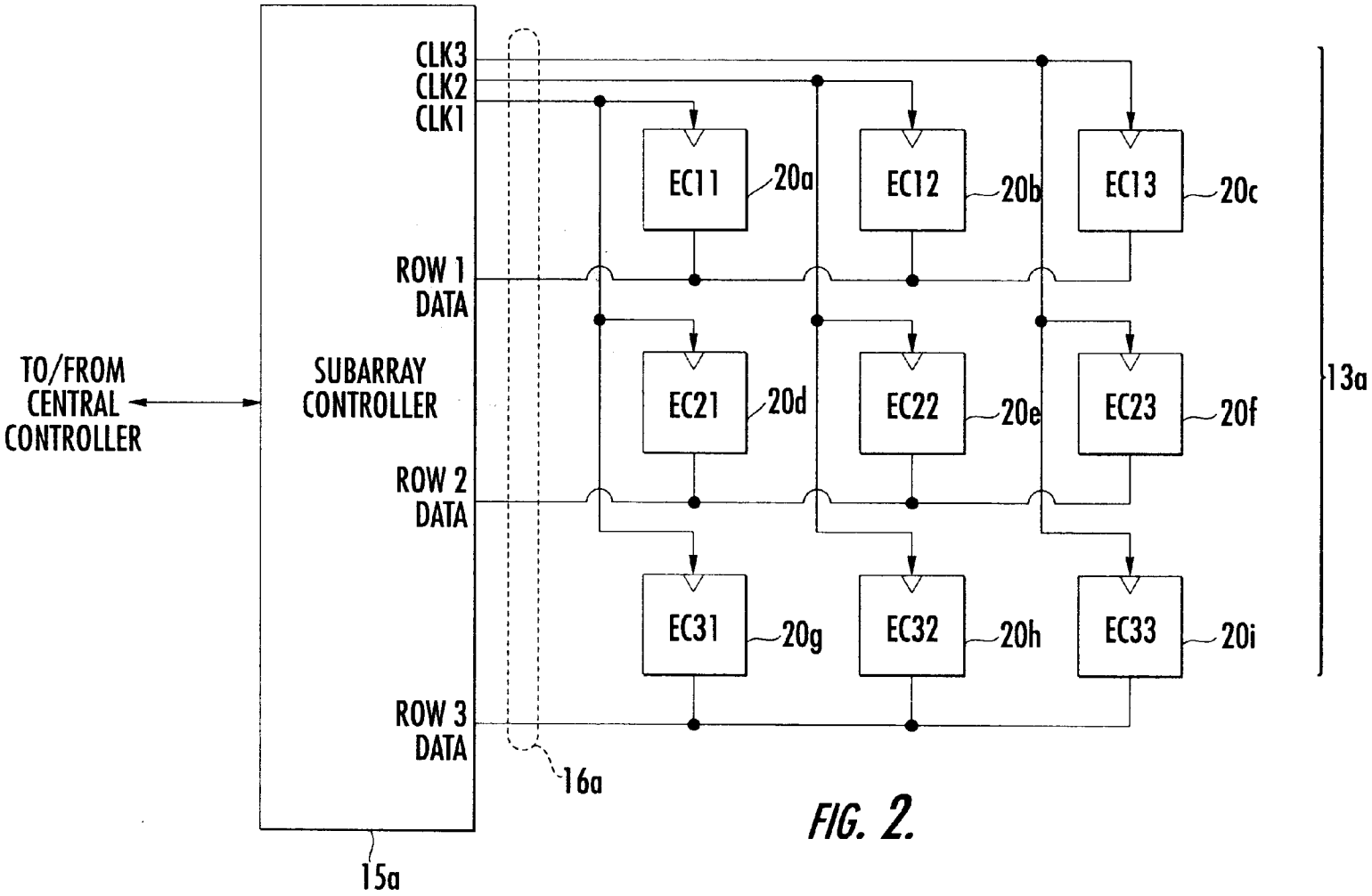
FIG. 2 is a more detailed schematic block diagram of a subarray controller and associated element controllers of the phased array antenna of FIG. 1.

Referring initially to FIGS. 1 and 2, a phased array antenna 10 according to the present invention illustratively includes a substrate 11 and a plurality of phased array antenna elements 12 carried by the substrate. As used herein, "substrate" refers to any surface, mechanized structure, etc., which is suitable for carrying a phased array antenna element, as will be appreciated by those of skill in the art. Furthermore, a plurality of element controllers 20 (FIG. 2) are connected to the phased array antenna elements 12.

As illustrated in FIG. 1, groups of element controllers 13*a*–13*n* are connected to (or integrated with) respective groups of antenna elements 14*a*–14*n*. More particularly, the groups of element controllers 13*a*–13*n* may include a respective element controller 20 for each antenna element 12 in a respective group of antenna elements 14*a*–14*n*. Of course, those of skill in the art will appreciate that a single element controller 20 may be used to control one or more antenna elements 12. It will also be appreciated that the element controllers 13*a*–13*n* may be integrated together with the various RF components for respective antenna elements 12 in an integrated MMIC module, for example.

The phased array antenna 10 also illustratively includes a respective subarray controller 15*a*–15*n* for each group of element controllers 13*a*–13*n*. Additionally, a plurality of data buses 16*a*–16*n* (shown with dashed lines in FIGS. 1 and 2) connect each subarray controller 15*a*–15*n* to respective columns and rows of element controllers 20. As illustrated in FIG. 2, for example, the group of element controllers 13*a* includes three columns of element controllers 20*a*, 20*d*, 20*g* (Column 1); 20*b*, 20*e*, 20*h* (Column 2); and 20*c*, 20*f*, 20*i* (Column 3). The group of element controllers 13*a* also includes three rows of element controllers 20*a*–20*c* (Row 1), 20*d*–20*f* (Row 2), and 20*g*–20*i* (Row 3). Thus, the group of element controllers 13*a* illustratively includes nine element controllers 20*a*–20*i*, but any number of element controllers may be used in accordance with the present invention.

The phased array antenna 10 also illustratively includes a central controller 17 connected to each of the subarray controllers 15*a*–15*n*. The central controller 17 may receive host commands from a host system (not shown), for example, for controlling beam steering or shaping, operating frequency, temperature compensation, etc. The central controller 17 distributes the host commands to the subarray controllers 15*a*–15*n*.

In some embodiments, the central controller 17 may also perform some degree of processing on the host commands, such as performing the requisite trigonometric processing to convert angles specified in the host commands into phase gradient data. For example, the central controller 17 may process the host commands and provide common beam control commands (e.g., including common phase gradient data) for all of the subarray controllers 15*a*–15*n*.

In such embodiments, the subarray controllers 15*a*–15*n* may then calculate basic (i.e., uncompensated) phase settings for each antenna element 12, and the element controllers 20 may then perform the requisite compensation (e.g., temperature compensation, etc.) for its respective antenna element 12. Alternately, the subarray controllers 15*a*–15*n* could essentially pass the common beam control commands (e.g., including common phase gradient data) to the element controllers 20 to perform their own phase setting calculations. Of course, those of skill in the art will appreciate that the central controller 17 could perform even further processing and provide the individual uncompensated (or even compensated) phase settings for each antenna element 12, for example, if desired.

It will also be appreciated by those of skill in the art that in some embodiments of the present invention a single subarray controller 15 may be used to perform such functions and thus serves as a central controller. This may be the case in a relatively small phased array antenna (i.e., having relatively few antenna elements 12), for example. Therefore, as used herein, the term "subarray controller" will be understood as either a high level controller connected between a host system and groups of elements controllers 13*a*–13*n*, or a mid-level controller connected between the central controller 17 and groups of elements controllers 13*a*–13*n* as illustrated in FIG. 1.

Each element controller 20 is preferably switchable between inactive and active data receiving states. According to the present invention, each subarray controller 15*a*–15*n* may advantageously cooperate with a respective data bus 16*a*–16*n* for sending data in parallel to a plurality of rows of element controllers 20 and while sequentially switching a given column of element controllers from the inactive data receiving state to the active data receiving state. To this end, each of the data buses 16*a*–16*n* may include a group of serial communication links through parallel buses may also be used.

Figure 3:
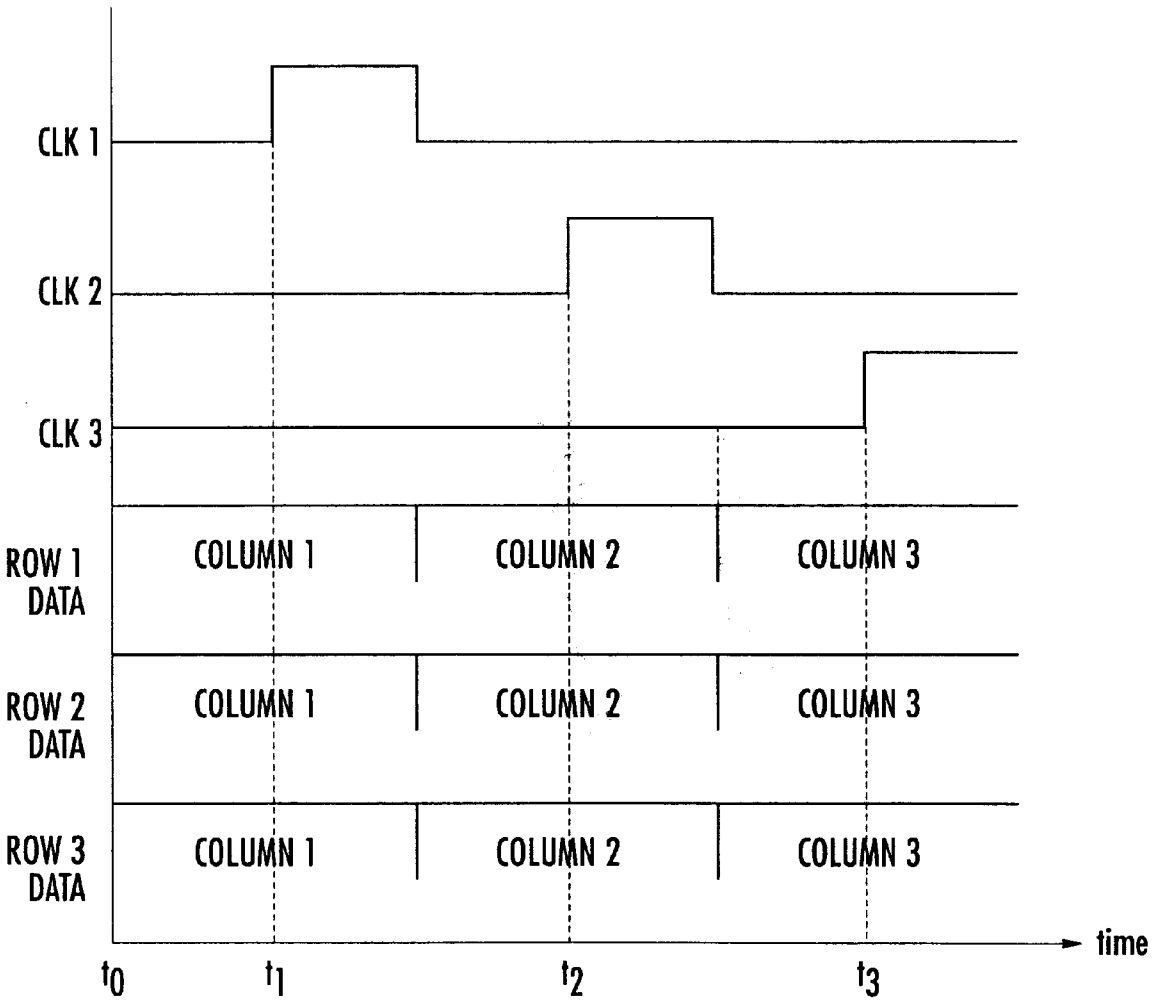
FIG. 3 is a timing diagram illustrating sequential element controller column switching according to the present invention.

The foregoing will be more clearly understood with reference to the timing diagram of FIG. 3. As illustrated in FIG. 2, the clock signals CLK1, CLK2, CLK3 are respectively provided to Columns 1, 2, and 3. Additionally, row data input/outputs Row 1 Data, Row 2 Data, and Row 3 Data are for respectively sending/receiving data to/from Row 1, Row 2, and Row 3. In the example illustrated in FIG. 3, at a time $t_1$, individual data for element controllers 20*a*, 20*d*, 20*g* are respectively being presented to all of the element controllers in Row 1, Row 2, and Row 3. Yet, since only the clock signal CLK1 is active during this time (i.e., the clock signals CLK1–CLK3 are offset from one another), only the element controllers 20*a*, 20*d*, and 20*g* of Column 1 are switched to the active data receiving state. As such, the element controllers 20*a*, 20*d*, and 20*g* are the only element controllers that will receive or "clock in" the data from the respective data outputs Row 1 Data, Row 2 Data, and Row 3 Data.

Likewise, at a time $t_2$, only the clock signal CLK2 is active. Thus, only the element controllers 20*b*, 20*e*, 20*h* of Column 2 will be switched to the active data receiving state and therefore clock in the data from the respective data outputs Row 1 Data, Row 2 Data, and Row 3 Data. Again, at the time $t_2$, the data output by the subarray controller 15*a* on the data outputs Row 1 Data, Row 2 Data, and Row 3 Data are individual data intended only for the element controllers 20*b*, 20*e*, 20*h*. In the same way, individual data is clocked in only by the element controllers 20*c*, 20*f*, 20*i* of Column 3 at a time $t_3$. It should be noted that although positive edge-triggered logic has illustratively been shown as an active clock signal, negative edge-triggered logic or level-triggered (i.e., write strobe) logic could also be used, as will be understood by those skilled in the art.

Accordingly, individual data may be clocked into (and from) each of the element controllers 20*a*–20*i* more quickly than in prior art approaches and without the need for potentially cumbersome address straps. Further, because of the enhanced utilization of data bus bandwidth, slower speeds may be used for the data buses 16*a*–16*n*. In addition, the clock signals CLK1–CLK3 used to switch the columns of element controllers 20 between the inactive and active data receiving states are generally less cumbersome to generate and transmit to individual element controllers. Thus, it will be appreciated by those of skill in the art that the present invention provides enhanced element controller data communication without the associated increases in logic complexity, power consumption, and cost that may accompany one or more of the above described prior art approaches.

Figure 4:
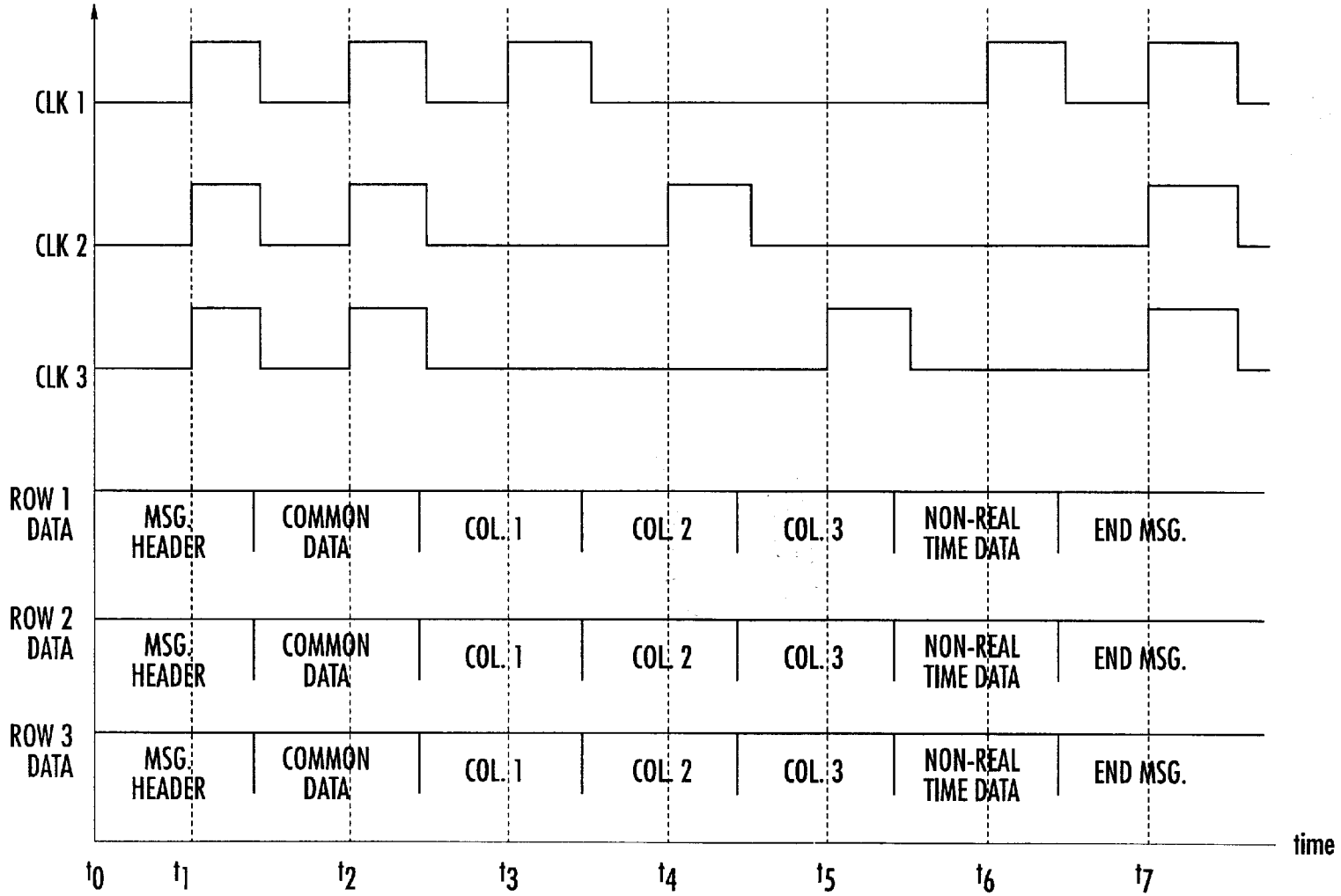
FIG. 4 is a more detailed timing diagram illustrating sequential and simultaneous element controller column switching according to the present invention.

Turning now additionally to FIG. 4, the subarray controller 13*a* may further switch a plurality of the columns Column 1 to Column 3 to the active data receiving state to send common data thereto. In the illustrated example, it may seen that at the times $t_1$ and $t_2$ all of the clock signals CLK1–CLK3 are active, thus causing all of the columns Column 1 to Column 3 to be in the active data receiving state. At the same time, common data to be used by all of the element controllers 20*a*–20*i* is provided on the data outputs Row 1 Data, Row 2 Data, Row 3 Data (i.e., the same data is provided on each of these outputs).

More particularly, at the times $t_1$ and $t_2$, this common data may include a common message header to proceed a particular sequence of beam steering data, for example. This avoids the increased overhead associated with various of the above noted prior art methods resulting from the need for separate message headers. Furthermore, at the time $t_2$ (plus similar additional cycles, if needed) other common data such as beam shape data (e.g., common coefficient or index number), temperature compensation data (e.g., temperature compensation index data), and operating frequency data (e.g., normalized operating frequency index data) may also be sent.

Sequential switching of the columns Column 1 to Column 3 provides individual beam steering data, for example, to respective element controllers 20*a*–20*i* may then occur from at the times $t_3$, $t_4$, and $t_5$ (plus additional cycles, if needed) until a time $t_5$. This sequential switching period is similar to that described above with respect to FIG. 3 and will therefore not be described again for clarity of explanation.

Additionally, the subarray controller 13*a* may also advantageously send or receive other "non-real time" data at a time $t_6$ (plus additional cycles, if needed) For example, the subarray controller 13*a* may send a telemetry request command to one or more of the columns Column 1 to Column 3. In the illustrated example, the first bit of a telemetry request command is being sent only to Column 1, since only the clock signal CLK1 is active. Upon receiving the bits of this command, each element controller 20*a*, 20*d*, 20*g* in Column 1 may respond to the telemetry request command by sending requested telemetry data. Of course, additional telemetry commands may subsequently be sent to the other columns, and other common data may be sent during this interval as well. Those of skill in the art will appreciate that by efficiently combining both real and non-real time bus traffic in such a manner, telemetry data is collected in a relatively convenient fashion which simplifies the task of performing "health checks" by higher level controllers (e.g., the central controller 17).

Further, at a time $t_7$ all of the clock signals CLK1–CLK3 may again become active for one or more cycles to send common data, such as an end of message indication to indicate that a particular data sequence has been completed. It should be noted that the particular intervals during which individual or common data are sent in the above example may be varied in their placement or duration, as will be appreciated by those of skill in the art. As such, numerous other combinations are possible other than that illustrated in the exemplary illustrations of FIGS. 3 and 4 and described herein. It should also be noted that the above described operation of the subarray controller 15*a* and its associated element controllers 20*a*–20*i* is representative of operation of the remaining subarray controllers and their respective element controllers.

Still further bandwidth efficiency may be achieved according to the present invention by using a "zero insert" serial data encoding protocol, for example, for sending commands and data via the bus 16*a*. Using this protocol, beam commands and data are sent as standard non-return-to-zero (NRZ) data, with the exception that a zero is inserted when a predetermined number of logic 1's (e.g., five) are sent in a row. By way of example, a data message of eight logic 1's (11111111) is encoded as 111110111. Additionally, encoded messages with more than five logic 1's in a row may be assigned a particular meaning, such as 011111110 as a "start of message" or 11111111 as a reset command for the element controllers 20*a*–20*i*.

As will be appreciated by those of skill in the art, the above zero insert encoding protocol reduces bandwidth requirements and simplifies the detection of message headers. Of course, other suitable encoding protocols such as 8B/10B, Manchester encoding, etc. may also be used in accordance with the present invention.

Figure 5:
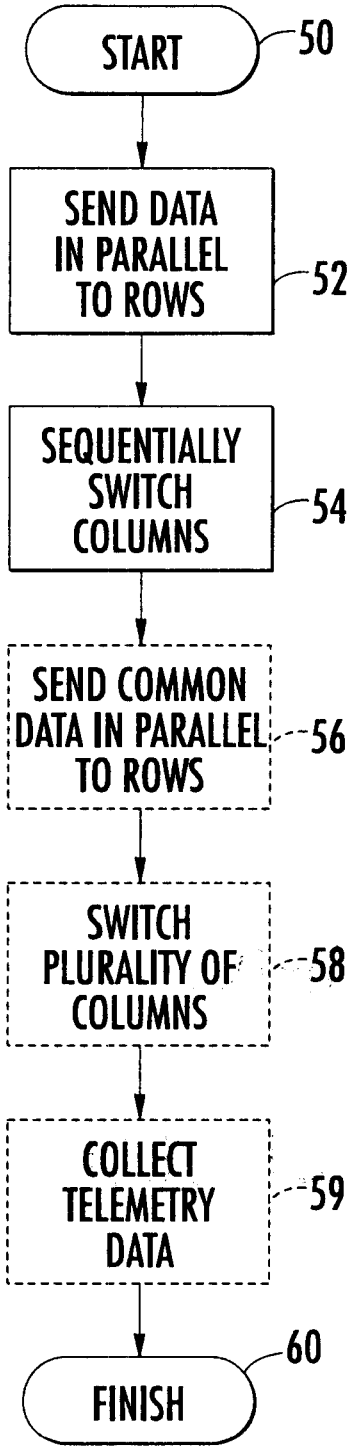
FIG. 5 is a flow diagram illustrating a method according to the present invention.

Referring now to the flow diagram illustrated in FIG. 5, a method for sending data between a subarray controller 13*a* and a plurality of element controllers 20*a*–20*n* in a phased array antenna 10 will now be described. Each element controller 20*a*–20*i* is preferably switchable between inactive and active data receiving states, as noted above. The method may begin (Block 50) with sending the data in parallel from the subarray controller 13*a* to a plurality of the rows Row 1-Row 3 of element controllers 20*a*–20*i*, at Block 52.

The method may further include sequentially switching a given column of the element controllers 20*a*–20*i* from the inactive data receiving state to the active data receiving state while sending the data (Block 54), as described above. Again, common data may optionally be sent to rows Row 1-Row 3 (Block 56), and a plurality of the columns Column 1-Column 3 may be switched to the active data receiving state (Block 58). Of course, telemetry data may optionally be collected as described above (Block 59), and the method concludes at Block 60. Additional aspects of the method will be understood by those of skill in the art based upon the foregoing description.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array antenna comprising:

a substrate and a plurality of phased array antenna elements carried by said substrate;

a plurality of element controllers connected to said phased array antenna elements, each element controller switchable between inactive and active data receiving states;

a plurality of subarray controllers; and a plurality of data buses, each data bus connecting a respective subarray controller to respective columns and rows of element controllers;

each subarray controller cooperating with a respective data bus for sending data in parallel to a plurality of rows of element controllers and while sequentially switching a given column of element controllers from the inactive data receiving state to the active data receiving state.

2. The phased array antenna according to claim 1 wherein each subarray controller sends data in parallel to all of the rows of element controllers and while sequentially switching a given column of element controllers from the inactive data receiving state to the active data receiving state.

3. The phased array antenna according to claim 1 wherein each subarray controller further switches a plurality of columns of element controllers to the active data receiving state to send common data thereto.

4. The phased array antenna according to claim 3 wherein the common data comprises at least one of beam shape data, temperature compensation data, and operating frequency data.

5. The phased array antenna according to claim 1 wherein each subarray controller further switches all columns of element controllers to the active data receiving state to send common data thereto.

6. The phased array antenna according to claim 1 wherein each subarray controller provides clock signals to switch the columns of element controllers between inactive and active data receiving states.

7. The phased array antenna according to claim 6 wherein the clock signals are offset in time from one another to sequentially switch the columns.

8. The phased array antenna according to claim 6 wherein respective clock signals are substantially the same to activate a plurality of columns.

9. The phased array antenna according to claim 1 wherein each subarray controller sends a telemetry request command to at least one column of element controllers; and wherein each element controller in said at least one column responds to the telemetry request command by sending requested telemetry data.

10. The phased array antenna according to claim 1 wherein the data comprises beam steering data.

11. The phased array antenna according to claim 1 wherein said plurality of element controllers comprises a respective element controller connected to each of said phased array antenna elements.

12. The phased array antenna according to claim 1 further comprising a central controller connected to said plurality of subarray controllers.

13. A phased array antenna comprising:

a substrate and a plurality of phased array antenna elements carried by said substrate;

a respective element controller connected to each of said phased array antenna elements, each element controller switchable between inactive and active data receiving states;

a plurality of subarray controllers; and a plurality of data buses, each data bus connecting a respective subarray controller to respective columns and rows of element controllers;

each subarray controller cooperating with a respective data bus for sending data in parallel to all of the rows of element controllers and while sequentially switching a given column of element controllers from the inactive data receiving state to the active data receiving state.

14. The phased array antenna according to claim 13 wherein each subarray controller further switches a plurality of columns of element controllers to the active data receiving state to send common data thereto.

15. The phased array antenna according to claim 14 wherein the common data comprises at least one of beam shape data, temperature compensation data, and operating frequency data.

16. The phased array antenna according to claim 13 wherein each subarray controller further switches all columns of element controllers to the active data receiving state to send common data thereto.

17. The phased array antenna according to claim 13 wherein each subarray controller provides clock signals to switch the columns of element controllers between inactive and active data receiving states.

18. The phased array antenna according to claim 17 wherein the clock signals are offset in time from one another to sequentially switch the columns.

19. The phased array antenna according to claim 17 wherein respective clock signals are substantially the same to activate a plurality of columns.

20. The phased array antenna according to claim 13 wherein each subarray controller sends a telemetry request command to at least one column of element controllers; and wherein each element controller in said at least one column responds to the telemetry request command by sending requested telemetry data.

21. The phased array antenna according to claim 13 wherein the data comprises beam steering data.

22. The phased array antenna according to claim 13 further comprising a central controller connected to said plurality of subarray controllers.

23. A phased array antenna comprising:

a substrate and a plurality of phased array antenna elements carried by said substrate;

a respective element controller connected to each of said phased array antenna elements, each element controller switchable between inactive and active data receiving states;

a plurality of subarray controllers; and a plurality of data buses, each data bus connecting a respective subarray controller to respective columns and rows of element controllers;

each subarray controller cooperating with a respective data bus for sending data in parallel to a plurality of rows of element controllers and while also sending clock signals offset in time from one another for sequentially switching a given column of element controllers from the inactive data receiving state to the active data receiving state.

24. The phased array antenna according to claim 23 wherein each subarray controller sends data in parallel to all of the rows of element controllers and while sequentially switching a given column of element controllers from the inactive data receiving state to the active data receiving state.

25. The phased array antenna according to claim 23 wherein each subarray controller further switches a plurality of columns of element controllers to the active data receiving state to send common data thereto.

26. The phased array antenna according to claim 25 wherein the common data comprises at least one of beam shape data, temperature compensation data, and operating frequency data.

27. The phased array antenna according to claim 23 wherein each subarray controller further switches all columns of element controllers to the active data receiving state to send common data thereto.

28. The phased array antenna according to claim 23 wherein each subarray controller provides clock signals to switch the columns of element controllers between inactive and active data receiving states.

29. The phased array antenna according to claim 23 wherein each subarray controller sends a telemetry request command to at least one column of element controllers; and wherein each element controller in said at least one column responds to the telemetry request command by sending requested telemetry data.

30. The phased array antenna according to claim 23 wherein the data comprises beam steering data.

31. The phased array antenna according to claim 23 further comprising a central controller connected to said plurality of subarray controllers.

32. A method for sending data between a subarray controller and a plurality of element controllers in a phased array antenna, each element controller being switchable between inactive and active data receiving states, the method comprising:

sending the data in parallel from the subarray controller to a plurality of rows of the element controllers; and sequentially switching a given column of the element controllers from the inactive data receiving state to the active data receiving state while sending the data in parallel.

33. The method according to claim 32 wherein sending comprises sending the data in parallel to all of the rows of element controllers.

34. The method according to claim 32 further comprising switching a plurality of columns of element controllers to the active data receiving state while sending common data thereto.

35. The method according to claim 34 wherein the common data comprises at least one of beam shape data, temperature compensation data, and operating frequency data.

36. The method according to claim 32 further comprising switching all of the columns of element controllers to the active data receiving state while sending common data thereto.

37. The method according to claim 32 wherein sequentially switching comprises providing offset clock signals to switch the columns of element controllers between inactive and active data receiving states.

38. The method according to claim 32 wherein the data comprises beam steering data.

* * * * *